US005733057A

United States Patent [19]

Noguchi

[11] Patent Number: 5,733,057

[45] Date of Patent: Mar. 31, 1998

[54] SLIDER FOR MECHANICAL PENCIL

[75] Inventor: Yoshio Noguchi, Kawagoe, Japan

[73] Assignee: Kotobuki & Co., Ltd., Kyoto, Japan

[21] Appl. No.: 431,031

[22] Filed: Apr. 28, 1995

[30] Foreign Application Priority Data

Oct. 28, 1994 [JP] Japan ..... 6-287142

[51] Int. Cl.[6] ..... B43K 21/027

[52] U.S. Cl. ..... 401/65; 401/80

[58] Field of Search ..... 401/65, 80, 53

[56] References Cited

U.S. PATENT DOCUMENTS 4,281,939 8/1981 Mitsuya .

4,714,365 12/1987 Kageyama et al. ..... 401/65

4,884,910 12/1989 Kageyama et al. ..... 401/80 X

*Primary Examiner*—Steven A. Bratlie

*Attorney, Agent, or Firm*—Rothwell, Figg, Ernst & Kurz

[57] ABSTRACT

A slider for a mechanical pencil comprises: a slider body provided with a through bore through which a lead is passed and disposed in the tip of a barrel so as to be axially slidable in a predetermined range; a lead guide concentrically fixed to the slider body so as to let the lead slide therethrough; a sliding part concentrically connected to the outer circumference of the rear end of the slider body so as to extend forward and to be able to slide against a predetermined frictional resistance relative to the inner circumference of the tip; and a lead guiding part disposed in one end of the slider body and capable of expansion and of applying a frictional resistance smaller than that applied to the sliding part by the inner circumference of the tip to the lead.

14 Claims, 7 Drawing Sheets

SLIDER FOR MECHANICAL PENCIL

BACKGROUND OF THE INVENTION

1. Field of the Invention

The present invention relates to a slider for a mechanical pencil and, more particularly, to a slider for a mechanical pencil provided with a lead guide which is forced to slide to project the lead.

2. Description of the Related Art

Generally, in a mechanical pencil having a tip member and a lead guide comprising a pipe and a chip and fixed to the front end of the tip member, the length of a portion of the lead projecting from the front end of the lead guide is limited to prevent breakage of the lead. Therefore, when writing for a long time, a push head provided on the rear end of a lead tank must be frequently pushed as the lead wears to feed the lead. Since one's grip on the mechanical pencil must be changed to push the push head for a lead feed operation, the lead feed operation reduces writing efficiency.

A slide type mechanical pencil provided with a lead guide which is operated for sliding when the lead wears and a mechanical pencil capable of feeding a desired length of the lead by pressing the lead against the writing paper or the like without requiring the change of grip on the mechanical pencil have been proposed to solve such a problem. For example, the assignee of the present patent application proposed in U.S. Pat. No. 4,714,365 a lead feed slider formed by concentrically arranging a larger tubular member and a smaller tubular member having a diameter different from that of the larger tubular member toward the rear, in which the larger tubular member is placed in sliding contact with the inner circumference of the tip member of a mechanical pencil so that a large frictional resistance acts thereon, and the smaller tubular member holds the lead securely so that a fixed frictional resistance acts on the lead.

Referring to FIGS. 1 to 3 showing this prior art lead feed slider, in a slider for a mechanical pencil, comprising a lead guide 11 disposed within the tip of a barrel so as to be axially slidable in a predetermined range, and a sliding member 12 fixed to the rear end of the lead guide 11, having an inner circumference capable of applying a fixed frictional resistance to the lead to hold the lead and an outer circumference in sliding contact with the inner circumference of the tip and capable of sliding against a frictional resistance greater than the frictional resistance acting on the lead, the sliding member 12 has a smaller tubular portion 13 and a larger tubular portion coaxial with the smaller tubular portion 13 and having a diameter larger than that of the smaller tubular portion 13, a plurality of axial recesses 15 are formed in the smaller tubular portion 13, the sliding member 12 is provided with an inner sliding piece 16 tapered toward a lead guiding part to hold the lead that slides through the lead guide by a frictional resistance, a plurality of recesses 17 formed in the larger tubular portion 14, and an outer sliding piece in sliding contact with the inner circumference of the tip and capable of sliding against a frictional resistance greater than the aforesaid frictional resistance.

In the prior art slider thus formed, the larger tubular portion and the smaller tubular portion are formed concentrically backward in a single body, and an annular gap opening toward the rear is formed in the rear end through which the lead is fed. Therefore, when inserting the lead in the slider, the lead is liable to enter the gap and hence it is difficult to guide the lead forward. Consequently, there is the possibility that the lead will be broken. Furthermore, particles of leads, fragments of leads and residual leads accumulated in the gap make the reliable action of the slider impossible.

SUMMARY OF THE INVENTION

The present invention has been made to solve the foregoing problems and it is therefore an object of the present invention to provide a slider for a mechanical pencil, capable of a) preventing breakage of the lead, of b) avoiding being stopped-up with particles of the lead, of c) reliably guiding, holding and feeding the lead, and of d) enabling writing for a long time without changing one's grip on the mechanical pencil.

With the aforesaid object in view, the present invention provides a slider for a mechanical pencil, comprising: a slider body provided with a through bore through which a lead is passed and disposed in the tip of a barrel so as to be axially slidable in a predetermined range; a lead guide concentrically fixed to the slider body to let the lead slide therethrough; a sliding part concentrically connected to the outer circumference of the rear end of the slider body so as to extend forward and to be able to slide against a predetermined frictional resistance relative to the inner circumference of the tip; and a lead guiding means disposed in one end of the slider body and capable of expansion and of applying a frictional resistance smaller than that applied to the sliding part by the inner circumference of the tip to the lead.

According to the present invention, the sliding part formed concentrically on the outer circumference of the sliding body of the slider is able to be held in sliding contact with the inner circumference of the tip by a sufficiently large frictional resistance, the slider is able to hold the lead securely by the lead guiding means provided on the sliding body by the predetermined frictional resistance, no gap is formed because the rear end of the slider body and the rear end of the sliding part are joined together and hence particles of leads, broken leads and residual leads are not accumulated and the lead can be smoothly guided toward the tip. Since the lead guiding means is flexible to facilitate the advancement of the lead, the lead can be reliably guided, held and advanced.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
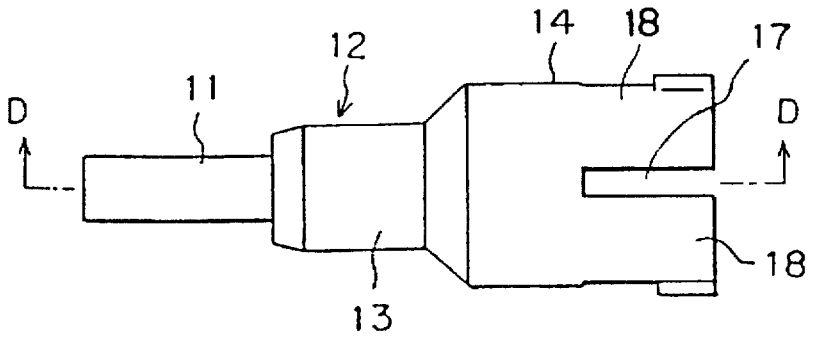
FIG. 1 (PRIOR ART)
FIG. 1 is a front view of a slider included in a conventional mechanical pencil.
Figure 2:
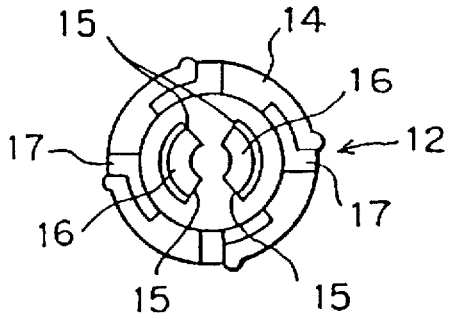
FIG. 2 (PRIOR ART)
FIG. 2 is a right end view of the slider of FIG. 1.
Figure 3:
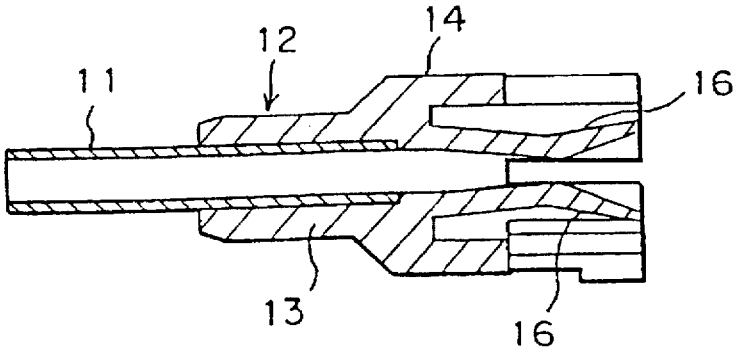
FIG. 3 (PRIOR ART)
FIG. 3 is a sectional view of the slider taken on line D—D in FIG. 1.
Figure 4:
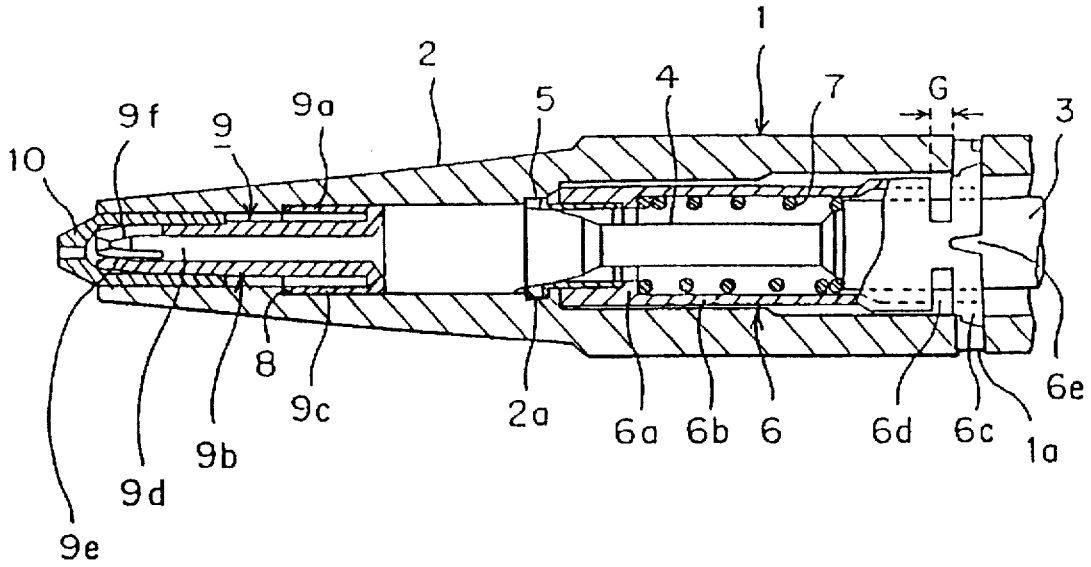
FIG. 4 is a longitudinal sectional view of an essential portion of a mechanical pencil provided with a slider in a first embodiment according to the present invention.
Figure 5:
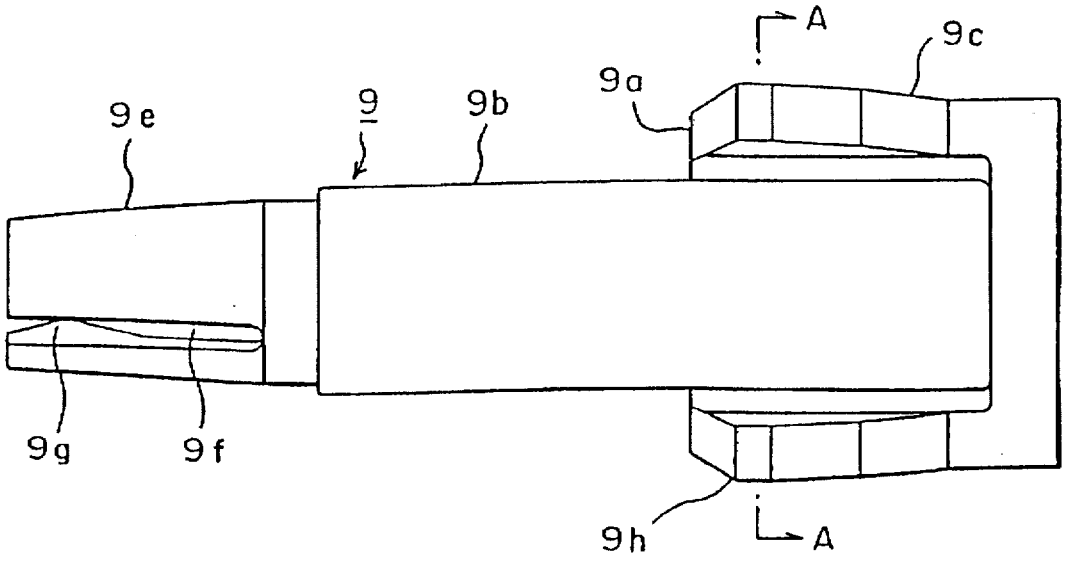
FIG. 5 is an enlarged front view of a slider shown in FIG. 4, in which lead guide is removed.
Figure 6:
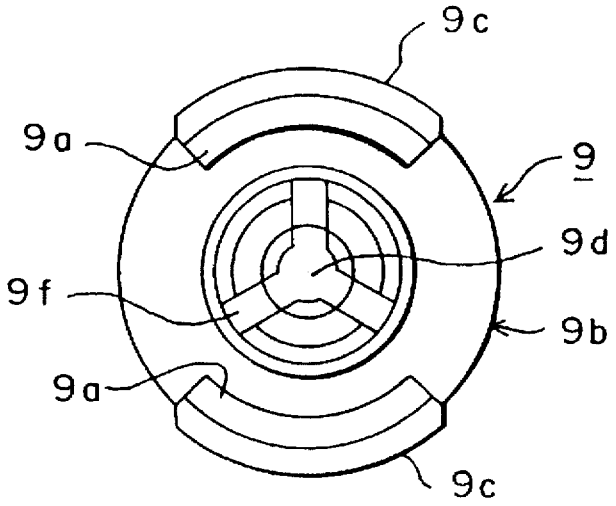
FIG. 6 is a left end view of the slider of FIG. 5.
Figure 7:
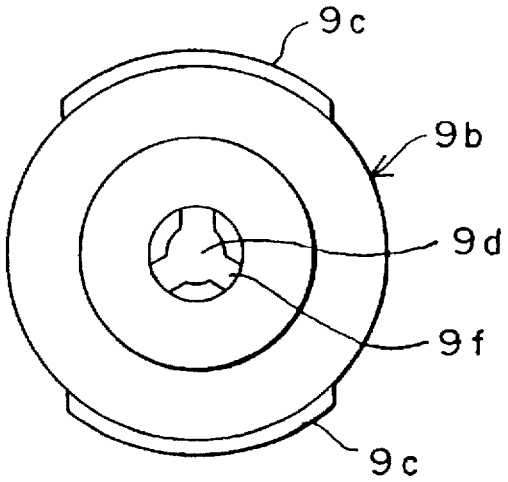
FIG. 7 is a right end view of the slider of FIG. 5.
Figure 8:
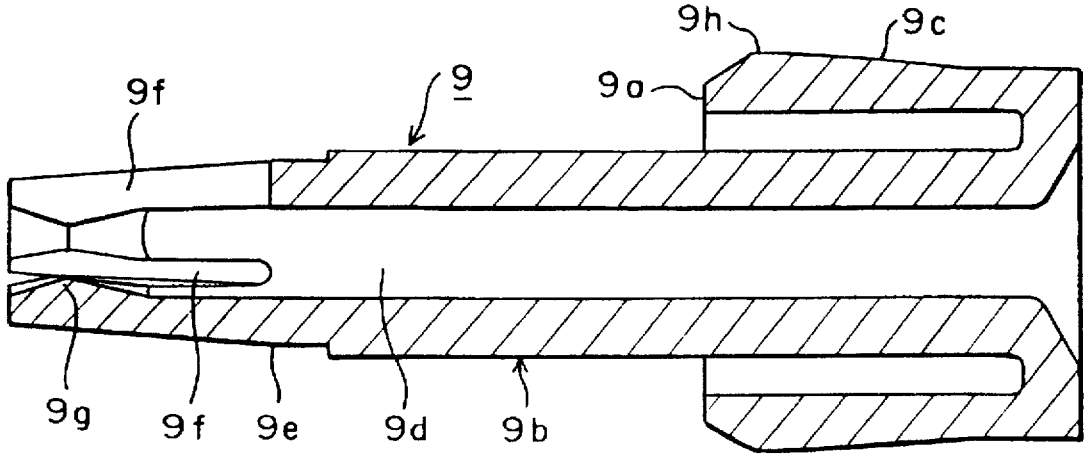
FIG. 8 is a longitudinal sectional view of the slider of FIG. 5.
Figure 9:
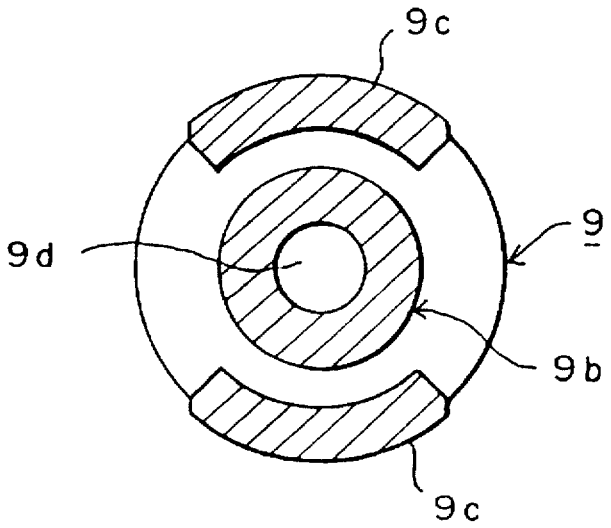
FIG. 9 is a sectional view of the slider taken on line A—A in FIG. 5.
Figure 10:
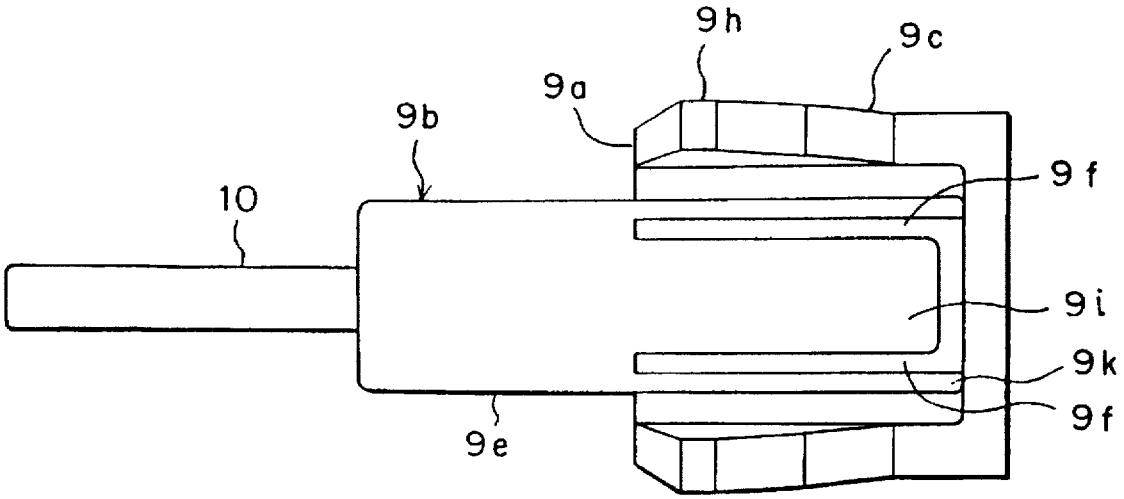
FIG. 10 is a front view of a slider in a second embodiment according to the present invention.
Figure 11:
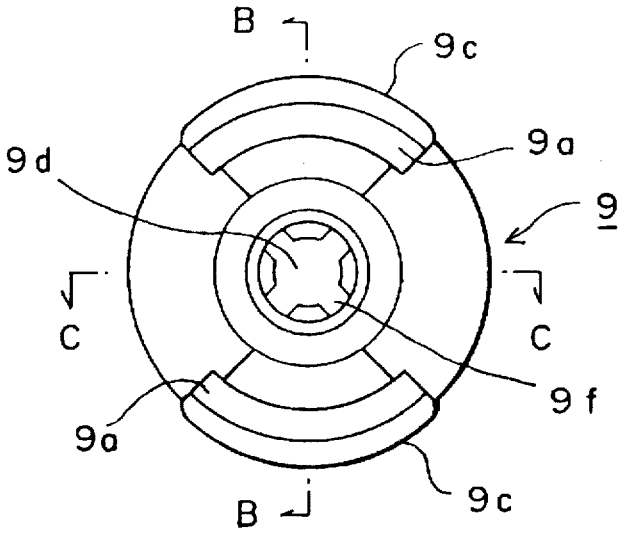
FIG. 11 is a left end view of the slider of FIG. 10.
Figure 12:
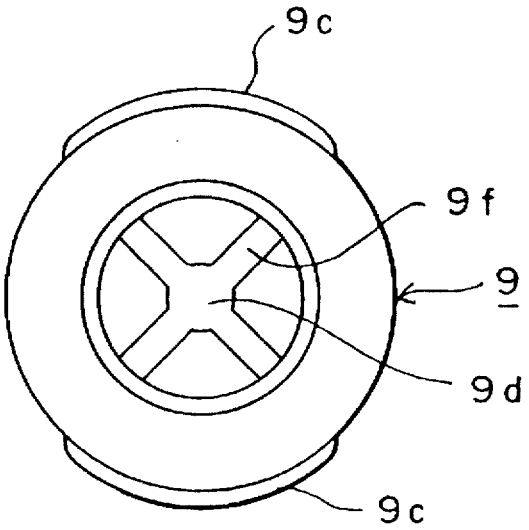
FIG. 12 is a right end view of the slider of FIG. 10.
Figure 13:
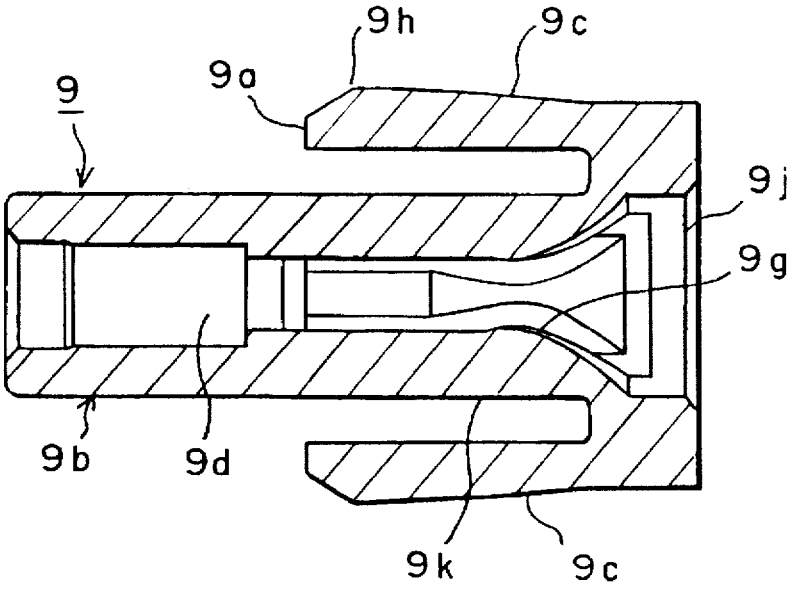
FIG. 13 is a sectional view of the slider taken on line B—B in FIG. 10.
Figure 14:
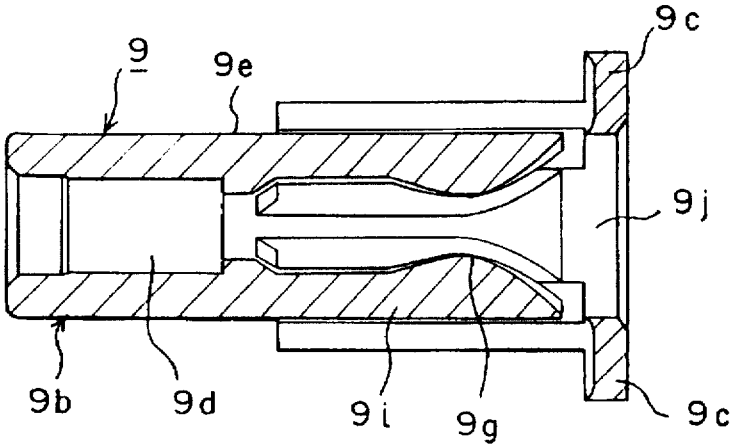
FIG. 14 is a sectional view of the slider taken on line C—C in FIG. 10.
Figure 15:
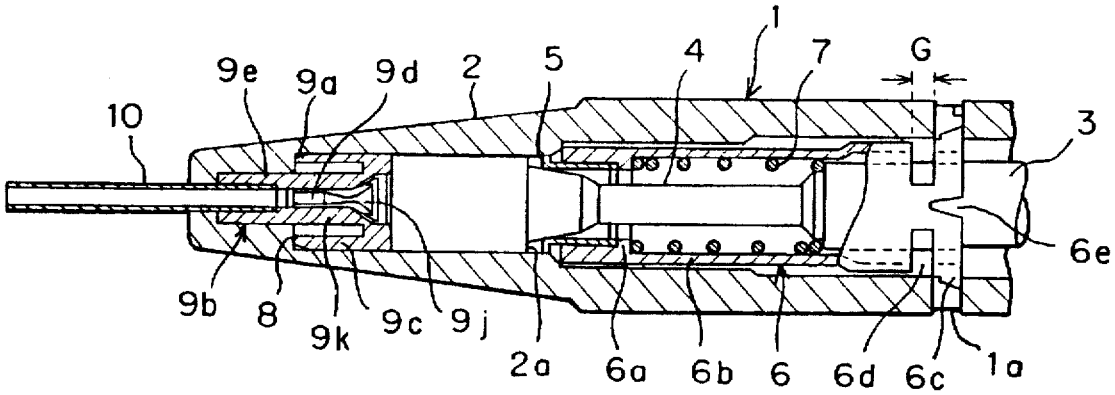
FIG. 15 is a longitudinal sectional view of an essential portion of a mechanical pencil, showing the slider of FIG. 10 in an operating state.

FIGS. 4 to 8 show a slider in a first embodiment according to the present invention. Referring to FIG. 4, a tip 2 is formed on the front end of a barrel 1 integrally with the barrel 1. A lead tank 3 is inserted in the barrel 1 coaxially for sliding movement, and a lead chuck 4 is fixedly attached to the front end of the lead tank 3. A knocking cap, not shown, is detachably put on the rear end of the lead tank 3 so as to slide relative to the barrel 1. A chuck ring 5 is put loosely on the front end of the lead chuck 4. The rear end of the chuck ring 5 faces an inside flange 6*a* formed on the inner surface of the front end of a cushion sleeve 6 axially movable within the barrel 1. The cushion sleeve 6 is an elastically deformable member and has a generally cylindrical shape. The rear end of the cushion sleeve 6 is expanded to form a stopping part 6*c* having a diameter greater than the outside diameter of the body part 6*b*. A radial recess 6*d* is formed in the body part 6*b* and an axial recess 6*e* is formed in the rear end to enable the stopping part 6*c* to produce a resilient force relative to the body part 6*b*. The stopping part 6*c* is formed in a shape so that the stopping part 6*c* can be surely and smoothly fitted in a stopping hole 1*a* formed in the barrel 1 when the cushion sleeve 6 is inserted together with a lead feed mechanism in the barrel 1 by a simple pushing action and the stopping part 6*c* will not rattle in the stopping hole 1*a*. The body part 6*b* moves elastically in a range corresponding to the axial gap G of the recess 6*d* relative to the stopping part 6*c* held in the stopping hole 1*a*. Normally, the body part 6*b* is biased forward. A chuck spring 7 is interposed between the front end of the lead tank 3 and the flange 6*a* of the cushion sleeve 6 to bias the lead tank 3 backward.

The front portion of the tip 2 is tapered toward the front in the shape of a circular cone. A tapered stopping step 8 is formed between portions of different diameters of the inner circumference of the front portion of the tip 2. A slider 9 having stopping parts 9*a* is axially slidably fitted in the front portion of the tip 2. The forward movement of the slider 9 is limited by the step 8. As shown in FIGS. 5 to 9, the slider 9 has a substantially cylindrical slider body 9*b*, and a sliding part 9*c*. The respective rear ends of the slider body 9*b* and the sliding part 9*c* are joined together in an integral piece. The slider 9 is an integral member formed of a synthetic resin, such as an ABS resin or a polyacetal resin. The front portion of the slider 9 is pressed in a lead guide 10 for guiding the lead, i.e., a tip member. The lead guide 10 is neither abraded nor damaged even if the same strikes on a paper sheet or the like during writing. Since the lead is held by the front portion of the slider 9 and only the outer surface of the slider body 9*b* is available for attaching, the lead guide 10 as shown in FIG. 4 is a suitable tip member. A lead guiding part 9*e* for holding the lead is formed in the front portion of the slider body 9*b*. More specifically, the lead guiding part 9*e* is provided with a bore tapering toward the front, a plurality of slits 9*f* extending backward from the front end, and lead holding protrusions 9*g* on the inner surface of the front end.

The rear end of the slider body 9*b* and the rear ends of the sliding part 9*c* are joined concentrically in an integral piece. In this embodiment, the sliding part 9*c* has two sliding lugs extending toward the front and capable of being radially and elastically strained. In a free state, i.e., in a state before the slider 9 is inserted in the tip 2, the outside diameter of the rear end of the sliding part 9*c* is greater than the inside diameter of the tip 2. Protrusions 9*h* are formed on the outer circumference of the sliding part 9*c*. A frictional resistance that acts on the outer circumference of the sliding part 9*c* when the sliding part 9*c* is brought into contact with the inner surface of the tip 2 is far greater than a frictional resistance applied to the lead by the inner surfaces of the lead holding protrusions 9*g*.

The operation of the slider in this embodiment will be described hereinafter with reference mainly to FIG. 4. In a state where any external force is not applied to the rear end of the lead tank 3, the cushion sleeve 6 is held at the front end of the range of its movement, and the lead is held firmly by the front end of the lead chuck 4 because the lead chuck 4 is biased backward relative to the chuck ring 5 as shown in FIG. 4. When the knocking cap, not shown, is knocked to push the lead tank 3 forward in this state, the lead chuck 4 is moved forward together with the chuck ring 5, and then the chuck ring 5 is disengaged from the lead chuck 4 and only the lead chuck 4 advances further to release the lead after the chuck ring 5 has been brought into contact with a step 2*a* formed in the inner surface of the tip 2.

When the force applied to the knocking cap is removed, the lead tank 3 is moved backward together with the lead chuck 4, the chuck ring 5 comes into contact with the front end of the cushion sleeve 6 and squeezes the front end of the lead chuck 4 to hold the lead, and then the lead tank 3 stops. This lead feed operation is repeated to feed the lead stepwise. The length of the lead by which the lead is fed by one cycle of the lead feed operation is approximately equal to the distance between the front end of the chuck ring 5 and the step 2*a*. When the lead feed operation is performed to advance the lead, the lead advances through the lead guide 10 because the frictional resistance applied to the lead by the protrusions 9*g* of the lead guiding part 9*e* is smaller than the frictional resistance applied to the protrusions 9*h* of the sliding part 9*c* by the inner circumference of the tip 2. Then, the mechanical pencil, similarly to the ordinary mechanical pencil, is used for writing.

When the tip of the lead is abraded or broken during writing, the remaining part of the lead is pressed against the paper sheet or the like without changing one's hold on the barrel 1. Then, a backward force acts on the lead chuck 4 holding the lead and the lead tank 3 to move the lead chuck 4 and the lead tank 3 together with the chuck ring 5 and the cushion sleeve 6 backward against the resilience of the stopping part 6*c*. The range of backward movement is about 0.5 to about 1.0 mm. Since the stopping parts 9*a* formed at the front end of the sliding part 9*c* are in contact with the step 8 of the barrel 1, the size of the range for the backward movement of those components is G at the maximum. When the lead is moved backward to the front end of the lead guide 10, the paper sheet applies a pressure to the lead guide 10 and the lead guide 10 moves backward together with the slider 9. When the lead is moved to the rear end of the range of its movement, the position of the lead coincides with that of the lead guide 10.

When one removes the pressure pressing the barrel 1 against the paper sheet, the resilience of the flexed stopping part 6c moves the body part 6b of the cushion sleeve 6 forward to the front end of the moving range and, consequently, the chuck ring 5 advances together with the lead chuck 4 and the lead held by the lead chuck 4 to its original position. However, the lead guide 10 is restrained from advancement by the large frictional resistance applied by the inner circumference of the tip 2 to the protrusions 9h of the sliding part 9c and hence the front end of the lead projects from the tip of the lead guide 10 by a length corresponding to the distance by which the lead guide 10 has been moved backward. The same operation can be repeated until the lead guide 10 reaches the rear end of its moving range.

If it is desired to further project the lead from the lead guide 10 after the point at which the lead guide 10 has reached the rear end of its moving range, the lead tank 3 is pushed axially for lead feed operation. When the lead tank 3 is pushed axially, the lead chuck 4 advances releasing the lead, the lead chuck 4 comes into contact with the rear end of the slider 9 and moves the slider 9 to the front end of its moving range. Then, the lead advances together with the slider 9 and hence the front end of the lead remains at the tip of the lead guide 10. When the force applied to the lead tank 3 is removed, the lead chuck 4 moves backward leaving the lead and the lead guide 10 at the same position, and stops after engaging with the chuck ring 5. The lead can be advanced gradually by a predetermined distance at a time by repeating the lead feed operation.

In the slider in the first embodiment, the lead guiding part 9e is located at the front end of the slider body 9b, no projections are formed in the surface of the through bore 9d formed in the slider body 9b, and the through bore 9d is a straight bore extending from the rear end of the slider body 9b to the lead guiding part 9e. Therefore, the lead, dropping by gravity, can readily advance and can be readily guided through the through bore 9d.

FIGS. 10 to 15 show a slider 9 in a second embodiment according to the present invention. While the slider 9 in the first embodiment holds the lead at its front end, the slider 9 in the second embodiment holds the lead at its rear end. A slider 9b is provided with a through bore 9d through which the lead moves. The slider 9 is fitted in the tip 2 of a barrel 1 so as to be axially movable in a predetermined range. A lead guide 10 is fixed concentrically to the front end of the slider body 9b, and the lead slides through the lead guide 10. The slider 9 has a sliding part 9c concentrically joined to the outer circumference of the rear end of the slider body 9b so as to extend forward, provided with a plurality of axial slits 9f and in sliding contact with the inner circumference of the tip 2 and held in place by a frictional resistance, and lead holding pieces 9i for applying a frictional resistance smaller than the frictional resistance applied to the sliding part 9c by the inner circumference of the tip 2 to the lead. The rear end of a lead guiding part 9e formed on the inner circumference of the rear end of the slider body 9b is joined to the rear end of the sliding part 9c, and has a plurality of connecting pieces 9k (FIG. 13), and a plurality of lead holding pieces 9i (FIG. 14) tapered backward, separated from the connecting pieces 9k by a plurality of slits 9f extending from the rear toward the front and having rear ends not connected to the sliding part 9c. The connecting pieces 9k and the lead holding pieces 9i are separated from each other by the slits 9f and are arranged alternately on a circle. An arcuate lead holding protrusion 9g protrudes inward from the rear end of each lead holding piece 9i.

The lead holding pieces 9i are formed so that the diameter of a circle circumscribed about the lead holding pieces 9i is equal to or greater than the diameter of a lead guiding opening 9j formed in the rear end of the lead guiding part 9e to prevent the lead being stopped when inserting the lead into the slider 9 from the rear end of the slider 9; that is, the outer surfaces of the lead holding pieces 9i are on the circumference of a circular cylinder corresponding to the inner circumference of the lead guiding opening 9j or on the circumference of a circular cylinder greater than the inner circumference of the lead guiding opening 9j. Since the lead can be easily guided into the lead guiding opening 9j without being caught and the rear ends of the lead holding pieces 9i are free, the lead holding pieces 9i can be easily bent radially outward and the lead can be automatically held.

The operation of the slider 9 in the second embodiment having the lead guiding part 9e at its rear end is substantially similar to that of the slider 9 in the first embodiment having the lead guiding part 9e at its front end. In this embodiment, the lead guide 10 may be a chip or a pipe. The slider body 9b and the lead guide 10 may be separate members or may be formed integrally. Naturally, the number of the slits 9f formed in the lead guiding part 9e of the slider body 9b need not be limited to three or four as shown in the drawings, and the number of the sliding pieces of the sliding part 9c need not be limited to two.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A slider for a mechanical pencil, said mechanical pencil including a barrel having a head section, a writing lead feeding mechanism disposed within said pencil barrel for advancing a writing lead toward the slider, and actuating means mounted on said writing lead feeding mechanism for actuating said writing lead feeding mechanism, said slider comprising:

a slider body slidably disposed in said head section;

said slider body adapted to be forwardly slid along an inner surface of said head section in a predetermined range by the writing lead feeding mechanism when the writing lead feeding mechanism is actuated by the actuating means, said slider body having front and rear ends;

a writing lead passageway extending through said slider body;

guide means provided at said front end of said slider body for guiding said writing lead;

said guide means having a writing lead outlet for allowing a tip portion of said writing lead to be operatively projected from said guide means, said guide means being provided at said front end of said slider body with said outlet communicating with said writing lead passageway;

said guide means being adapted to be operatively projected from said head section as said slider body is forwardly slid;

writing lead holding means provided around a periphery of a predetermined region of said writing lead passageway;

said writing lead holding means being adapted to hold said writing lead to a degree that said writing lead is allowed to be slid along said writing lead passageway, so that when said writing lead is slid along said writing lead passageway while being held by said holding means, a first frictional resistance is produced between said writing lead and said holding means;

an annular section provided around a periphery of said rear end of said slider body; and radially deformable resilient means extending forwardly from said annular section;

said slider body being resiliently supported with respect to the inner surface of the head section through said radially deformable resilient means, so that when said slider body is forwardly slid along the inner surface of the head section, a second frictional resistance is produced between said resilient means and the head section, said second frictional resistance being smaller than said first frictional resistance.

2. The slider as defined in claim 1 wherein said predetermined region of said writing lead passageway is a front end portion of said writing lead passageway, around a periphery of which said holding means is disposed.

3. The slider as defined in claim 2, wherein said holding means comprises first spaced apart slits disposed around a circumferential wall of said front end portion of said writing lead passageway and axially extending rearward from an edge of a front end of said circumferential wall, and first radially deformable resilient pieces defined by said first slits and extending forwardly in a manner to be gradually concentrated toward an axial center line of said writing lead passageway.

4. The slider as defined in claim 3, wherein each of said first radially deformable resilient pieces includes a writing lead holding protrusion provided on an inner surface thereof.

5. The slider as defined in claim 2, wherein said radially deformable resilient means comprises spaced apart resilient pieces extending forwardly from said annular section.

6. The slider as defined in claim 1, wherein said predetermined region of said writing lead passageway is a rear end portion of said writing lead passageway, around a periphery of which said holding means is disposed.

7. The slider as defined in claim 6, wherein said holding means comprises first spaced apart slits disposed around a circumferential wall of said rear end portion of said writing lead passageway and extending axially, and first and second pieces defined by said first slits and disposed alternately around said rear end portion of said writing lead passageway, each of said first pieces connected to said annular section, each of said second pieces being disconnected from said annular section, so that said second pieces are radially deformable, and wherein said writing lead passageway has a writing lead inlet at the rear end thereof, a part of said writing lead passageway which is surrounded by said second pieces is equal to or greater in measure than a diameter of said writing lead inlet.

8. The slider as defined in claim 7, wherein each of said second pieces has an arcuate protrusion curved toward said writing lead passageway.

9. The slider as defined in claim 8, wherein said slider body and said guide means are formed as a one piece member comprising said slider body and said guide means.

10. The slider as defined in claim 7, wherein said slider body and said guide means are formed as a one piece member comprising said slider body and said guide means.

11. The slider as defined in claim 6, wherein said slider body and said guide means are formed as a one piece member comprising said slider body and said guide means.

12. The slider as defined in claim 6, wherein said radially deformable resilient means comprises spaced apart resilient pieces extending forwardly from said annular section.

13. The slider as defined in claim 1, wherein said radially deformable resilient means comprises spaced apart resilient pieces extending forwardly from said annular section.

14. The slider as defined in claim 13, wherein each of said resilient pieces includes a protrusion projecting outwardly therefrom.

* * * * *

UNITED STATES PATENT AND TRADEMARK OFFICE

CERTIFICATE OF CORRECTION

PATENT NO. : 5,733,057
DATED : March 31, 1998
INVENTOR(S) : Yoshio Noguchi

It is certified that error appears in the above-identified patent and that said Letters Patent is hereby corrected as shown below:

Column 7, claim 1,
Line 14, "second" should be -- first --.
Line 15, "first" should be -- second --.

Signed and Sealed this

Second Day of April, 2002

*Attest:*

*Attesting Officer*

JAMES E. ROGAN
*Director of the United States Patent and Trademark Office*